United States Patent [19]

Maffet

[11] 4,161,825

[45] Jul. 24, 1979

[54] PLASTICIZED ORGANIC WASTE

[75] Inventor: Vere Maffet, West Chester, Pa.

[73] Assignee: UOP Inc., Des Plaines, Ill.

[21] Appl. No.: 858,879

[22] Filed: Dec. 8, 1977

Related U.S. Application Data

[63] Continuation-in-part of Ser. No. 813,578, Jul. 7, 1977, Pat. No. 4,099,336, and a continuation-in-part of Ser. No. 813,577, Jul. 7, 1977, Pat. No. 4,098,006, each is a continuation-in-part of Ser. No. 775,673, Mar. 8, 1977.

[51] Int. Cl.[2] ..... F26B 7/00

[52] U.S. Cl. ..... 34/12; 71/12

[58] Field of Search ..... 34/12; 71/12; 210/10; 44/10 R, 10 H

[56] References Cited

U.S. PATENT DOCUMENTS

| | | | |
|---|---|---|---|
| 3,592,617 | 7/1971 | Alpan et al. | 44/10 H |
| 3,667,131 | 6/1972 | Stephanoff | 34/10 |
| 4,004,893 | 1/1977 | Cummings et al. | 44/10 H |
| 4,082,532 | 4/1978 | Imhof | 34/12 |

*Primary Examiner*—John J. Camby

*Attorney, Agent, or Firm*—James R. Hoatson, Jr.; John F. Spears, Jr.; William H. Page, II

[57] ABSTRACT

A composition of matter comprising a plasticized organic waste, preferably dried sewage sludge. Fibrous reinforcing media may also be present. Plasticization of the dried organic waste is performed by the simultaneous application of an elevated temperature and pressure. Articles of manufacture are produced by extruding or otherwise forming the plasticized organic waste into a desired shape and then cooling the formed material.

13 Claims, No Drawings

PLASTICIZED ORGANIC WASTE

CROSS-REFERENCE TO RELATED APPLICATIONS

This application is a continuation-in-part of my prior applications Ser. No. 813,577, filed on July 7, 1977, now U.S. Pat. No. 4,098,006, and 813,578 filed on July 7, 1977, now U.S. Pat. No. 4,099,336. Both of these prior applications are a continuation-in-part of my prior application Ser. No. 775,673 filed Mar. 8, 1977. The teachings of my prior applications are incorporated herein by reference.

FIELD OF THE INVENTION

The invention relates to a composition of matter and to an article of manufacture, both of which comprise plasticized organic waste. The invention directly relates to the plasticization of dried sewage sludge by the simultaneous application of an elevated temperature and pressure and to the production of useful articles by the extrusion or molding of the plasticized dried sewage sludge. The invention also relates to the disposal and utilization of sewage sludge.

PRIOR ART

The disposal of sewage sludge and other organic wastes in an economic and environmentally acceptable manner has been recognized as a significant problem. Various solutions have been proposed. These include the use of dried sludge as a fertilizer or soil conditioner as is described in U.S. Pat. No. 3,802,089 (Cl. 34-8). In U.S. Pat. No. 4,028,130 (Cl. 106-120), a different method of disposing of municipal sewage sludge is presented. In this method, the sludge is incorporated in a hardenable composition including, for example, lime, fly ash and, in some cases, alkaline earth metal sulfates and other additives. The products are described as hardenable under atmospheric conditions. This reference is not believed to teach the application of superatmospheric pressures or of temperatures above 55° C. to the sludge-containing admixtures which are formed.

Sewage sludge has been dewatered in an apparatus comprising a screw conveyor which rotates within a cylindrical perforated barrel, with the dewatered sludge being discharged from the end of the barrel in a manner resembling extrusion. This operation is described in U.S. Pat. Nos. 3,695,173 (Cl. 100-74) and 4,041,854 (Cl. 100-112). The feed to the dewatering apparatus shown in these references is not a dried sludge, and elevated temperatures are not applied to the material within the apparatus.

The plasticization of dried sewage sludge is described in my prior applications Ser. Nos. 813,577, filed July 7, 1977, now U.S. Pat. No. 4,098,006, and 813,578 filed on July 7, 1977, now U.S. Pat. No. 4,099,336. These applications are directed to improvements in the drying of solid wastes, including sewage sludge, and in the pelletization of the dried solid waste. The plasticization of sewage sludge dried in these processes is part of the preferred mode of operation of the processes claimed in these applications.

BRIEF SUMMARY OF THE INVENTION

The invention provides a high value composition of matter, useful in the fabrication of many articles of commerce, and which is derived from low cost sewage sludge. The invention also provides an article of manufacture which is economically formed from plasticized sewage sludge. One embodiment of the invention may be characterized as a composition of matter which comprises plasticized sewage sludge produced in a process comprising the steps of drying sewage sludge to less than 15 wt.% water; plasticizing the resultant dried sewage sludge at plasticization-promoting conditions including a temperature above about 110° C. and a pressure above about 300 psig.; and cooling the plasticized sewage sludge to a temperature under 100° C.

DETAILED DESCRIPTION

The large amount of sewage sludge which is produced in municipal sewage treatment plants presents a large and troublesome disposal problem. As environmental regulation of sewage discharge and disposal procedures increases, the problem of sludge disposal will also increase. Several methods of sludge disposal have been developed, and more are presently under development. The methods which are already practiced include dumping the sludge off shore or into an available landfill. A variation of this method is the utilization of wet or partially dried sludge as a soil builder used in the reclamation of strip mined land areas. Sewage sludge is also converted into a useful fertilizer by drying and pelletization.

Municipalities have been reluctant to adopt the more recently developed sewage sludge disposal methods because of their various disadvantages, which may include large monetary expenditures for construction and/or operation or the production of large quantities of low value products. Generally, most methods of sludge disposal are basically directed to the elimination of the sludge and cannot be characterized as methods which appreciably upgrade the sludge or produce a marketable and valuable product. It is an objective of this invention to provide a valuable article of manufacture using sewage sludge as a raw material. Another objective of the invention is to provide a unique composition of matter comprising sewage sludge. Yet another objective of the invention is to provide a low cost substitute for plastic and other materials which can be fabricated into various articles of commerce.

The basic raw material used in the practice of the subject invention is dried sewage sludge derived from a primary, secondary, or tertiary sludge which is either digested or undigested. The sludge produced in a municipal sewage treatment plant will typically contain about 20 wt.% solids, with the remainder being water and a very small amount of hydrocarbons. The raw sludge may therefore contain about 80 wt.% water. The water content of the raw sludge should be reduced to less than 15 wt.%, and preferably less than 12 wt.%, before it is utilized in the subject invention as dry sludge. This drying of the raw sludge may be performed in any manner including any of the processes described in my prior applications. The drying of the sludge can therefore be performed using a toroidal dryer, a rotating kiln, or any other apparatus in which the sludge is heated under conditions which promote the evaporation of water. The sludge may also be dried naturally at ambient conditions either indoors or exposed to the environment. Mechanical dryers which achieve the desired degree of water removal may also be used if available. It is preferred that the sludge is dried in a manner which provides a loose free-flowing dry material and which does not allow the sludge to ferment or spoil at semi-humid conditions.

In the subject invention, the dried sludge is plasticized. As used herein, the term "plasticized" or variations of it are intended to refer to the physical conversion of a solid material into a semi-fluid substance having flow properties similar to that of a high viscosity fluid and which is easily moldable into various shapes.

It has now been discovered that dried sewage sludge may, surprisingly, be plasticized and formed into homogeneous appearing articles of manufacture. Upon cooling, the composition of matter formed in this manner is found to have good structural strength and a high electrical resistivity. It appears impervious to water and other common solvents to which it has been exposed. These characteristics make the plasticized sewage sludge appear to be an inexpensive alternative to petroleum-derived thermosetting plastics. It apparently may be extruded into articles having an endless variety of shapes and sizes. These articles range from utilitarian items, such as golf tees and containers, to building materials including paneling and insulation. The color of the plasticized sewage sludge ranges from a light dappled brown to an almost ebony black depending on the characteristics of the input material and the plasticization-promoting conditions employed. The specific gravity of extrudates has ranged from about 0.75 to approximately 1.5, and is dependent on these same variables.

Plasticization of the dried sewage sludge is performed at conditions which include the simultaneous application of both heat and pressure. The application of either pressure or heat alone does not plasticize the dried sludge. For instance, a direct pressure of about 20,000 psi. at 25° C. does not cause dried sludge to plasticize, but yields a compacted mass composed of the original mixture of fibers and grains. However, it has been discovered that plasticization is, surprisingly, achieved by the combined application of a moderately elevated temperature and a relatively low pressure.

The minimum suitable plasticization temperature appears to be approximately 100° C. and the minimum required pressure is about 300 psig. Plasticization normally occurs, at least to some extent, at this combination of temperature and pressure. More extreme conditions can be applied. The minimum temperature and pressure required for plasticization may be interrelated and may be dependent on the exact composition of the dried sewage sludge. Preferably, the plasticization-promoting conditions used in the performance of the invention include a pressure above 500 psig. and a temperature above 110° C. The application of excessive heat to the dried sludge causes the dried sludge to begin to char or oxidize. This appears to begin at about 170° C., and it is believed the charring of the dried sludge is undesirable. An especially preferred range of plasticization-promoting temperatures is from 110° C. to about 170° C. It is apparently unnecessary to limit the pressure applied during plasticization and pressures on the order of 10,000 to 20,000 psig. may be applied, but a pressure below about 1000 psig. is preferred.

The plasticization is preferably accomplished by the simultaneous application of moderately elevated temperature and pressure, such as occurs in the barrel of a rotating-screw extruder. The application of pressure is inherent in the extrusion process. The dried sludge may be heated and then passed into the barrel of the extrusion mechanism in which it is compressed. Heat dissipation of some of the work energy expended in extruding the sludge will also occur and appears sufficient to maintain the material in a plasticized state until it is extruded. If desired, additional heat may be applied through the barrel of the extruder. A method and apparatus for preparing a plasticized material in an extrusion apparatus is presented in U.S. Pat. No. 4,049,245 (Cl. 259-191). A commercially available extruder was used in the experimentation incident to the subject invention, and no extraordinary mechanical equipment appears necessary.

The composition of sewage sludge will vary from one municipality to another and will also change with time. Besides the wide variety of materials found in raw sewage, the sludge will also contain a wide variety of organic and inorganic chemical compounds which were disposed of by being deposited in the sewage collection system. In addition, various flocculating agents and other chemicals may be admixed into the sewage or sludge during its processing after collection. These materials may act as cross-linking agents which are beneficial in the plasticization of the dried sludge. The sewage sludge will normally contain some volatile organic chemicals. A varying portion of these will be vaporized during the drying of the raw sludge, with the amount vaporized being dependent on the temperature, pressure, etc., used in the drying step. It is therefore impossible to provide a detailed chemical analysis of the raw material of the subject composition of matter which would be correct in all cases. As a result, the subject composition of matter appears to be best characterized by the source of the raw material and the method by which it is produced.

The subject invention also comprises an article of manufacture which is produced from the unique composition of matter described herein. One embodiment of this article of manufacture is produced by a series of steps which comprises drying sewage sludge to a water content below 15 wt.%; heating the dried sludge to a temperature above 100° C. and compressing the sewage sludge at a pressure above 300 psig. to effect the plasticization of the dried sewage sludge; extruding the plasticized sewage sludge through a die and forming an extrudate; and cooling the extrudate to a temperature below 100° C. Preferably, the extrudate is cooled to an ambient temperature of about 25° C. or less. The cooled extrudate may then be put through one or more finishing operations in which it is further shaped by drilling, cutting, or milling, etc. One or more pieces of the finished extrudate may be assembled to form the finished article.

Various additives may be admixed into the dried sewage sludge prior to plasticization. These include extrusion aids, such as bentonite, and formaldehyde, which is a known cross-linking agent. A partial list of known organic cross-linking agents which are contemplated for use as plasticizers contains various aldehydes and ketones and includes acetaldehyde, propionaldehyde, butyraldehyde, glycol aldehyde, aldol, glyceric aldehyde, glyoxal, p-glyoxal, mesoxydialdehyde, acrolein, crotonaldehyde, dibroacrolein, mucochloric acid, o-salicylaldehyde, resorcyclic aldehyde, diacetyl, acetonyl acetone, hydroquinone, camphor, dibutyl phthalate, butyl benzyl phthalate, dimethyl phthalate, diethyl phthalate, aromatic phosphates and sulfonamides, bis(2-ethylhexyl) adipate, dibutyl sebacate, raw castor oil, mineral oil, tricresyl phosphate, alkyd resins, hydrogenated terphenyls, diphenyl phthalate, polyalkylene glycol, butoxyethyl sterate and poly-α-methylstyrene. Some of the known inorganic cross-linking agents contemplated for use as a plasticizer are $Al_2O_3$, $Cr_2O_3$, $Fe_2O_3$, $ZnO_2$, $TiO_2$, $SiO_2$, $Al_2(SO_4)_3$, $Fe(NH_4)(SO_4)_2$, $Ti(NO_3)_4$, and $K_2Al_2(SO_4)_4.24H_2O$.

In another embodiment of the invention, a fibrous reinforcing media is admixed into the sewage sludge prior to the plasticization of the dried sludge. Preferably, this reinforcing media comprises from about 1.0 to 20 wt.% of the resulting admixture. A wide variety of substances may be used as the reinforcing media. These range from chopped strands of cotton and nylon to more exotic substances such as graphite or alumina fibers or other high strength materials. The reinforcing media is preferably in the form of thread-like strands having a length less than about 2.5 centimeters.

Another embodiment of the invention comprises the production of articles of manufacture without the extrusion of the plasticized sewage sludge. In this embodiment, a measured amount of the dried sewage sludge is placed into a break-away mold having the shape of the desired article of manufacture or its precursor. The dried sewage sludge may be heated before or after insertion into the mold. Preferably, the dried sludge is distributed about the mold as evenly as is practical. The remaining portion of the mold is then properly positioned and the dried sewage sludge is pressurized within the mold to effect the desired plasticization. The plasticized sewage sludge conforms to the shape of the mold as a result of its liquid-like flow characteristics. The molded article may then be cooled in-situ. In yet another embodiment of the invention, the plasticized sewage sludge is formed into the desired shape by injection into a mold. This operation may be performed in a manner similar to the injection molding of commonly used plastics.

I claim as my invention:

1. A plasticized composition comprising sewage sludge dried to less than 15 wt.% water and plasticized at a temperature of at least about 100° C. and a pressure of at least about 300 psig.

2. The composition of claim 1 further characterized in that the sludge is plasticized at a temperature above 110° C. and a pressure above 500 psig.

3. The composition of matter of claim 2 further characterized in that the sewage sludge is dried to less than 12 wt.% water prior to plasticization.

4. The composition of matter of claim 5 further characterized in that the sludge is plasticized at a temperature of from about 110° C. to about 170° C.

5. The composition of matter of claim 2 further characterized in that the plasticized sewage sludge is extruded.

6. A composition of matter comprising a plasticized mixture of dried sewage sludge containing less than 15 wt. % water and from about 1 to 20 wt. % fibrous reinforcing material, said mixture having been plasticized at a temperature of at least about 100° C. and a pressure of at least about 300 psig.

7. The composition of claim 6 further characterized in that said plasticized mixture is in the form of an extrudate.

8. A process comprising the steps of:

(a) drying sewage sludge to less than 15 wt.% water;

(b) extruding the so-formed dried sewage sludge at a pressure above 300 psig. and a temperature of from about 110 to about 170° C. to form an extrudate; and, (c) cooling the resultant extrudate.

9. A process comprising the series of steps of:

(a) drying sewage sludge to a water content below 15 wt.%;

(b) heating the dried sewage sludge to a temperature above 100° C. and compressing the sewage sludge to a pressure above 300 psig. and effecting the plasticization of the dried sewage sludge;

(c) forming the plasticized sewage sludge into a desired shape; and, (d) cooling the plasticized sewage sludge to a temperature below 100° C.

10. The process of claim 9 further characterized in that the dried sewage sludge comprises less than 12 wt.% water.

11. The process of claim 10 further characterized in that the plasticization of the dried sewage sludge is effected at a temperature above 110° C. and at a pressure above 500 psig.

12. The process of claim 10 further characterized in that the sewage sludge is dried in a toroidal dryer.

13. The process of claim 9 further characterized in that the plasticized sewage sludge is formed into the desired shape by injection into a mold.

* * * * *